US009339688B1

(12) United States Patent
Campbell

(10) Patent No.: US 9,339,688 B1
(45) Date of Patent: May 17, 2016

(54) CORE EXERCISE APPARATUS

(71) Applicant: Sophia Loren Campbell, Phoenix, AZ (US)

(72) Inventor: Sophia Loren Campbell, Phoenix, AZ (US)

( * ) Notice: Subject to any disclaimer, the term of this patent is extended or adjusted under 35 U.S.C. 154(b) by 0 days.

(21) Appl. No.: 13/901,272

(22) Filed: May 23, 2013

(51) Int. Cl.
*A63B 26/00* (2006.01)
*A63B 23/02* (2006.01)

(52) U.S. Cl.
CPC ..... *A63B 23/0205* (2013.01); *A63B 23/0211* (2013.01); *A63B 2208/0242* (2013.01)

(58) Field of Classification Search
CPC ..... A63B 23/02; A63B 23/0205; A63B 23/0211; A63B 23/0222; A63B 2208/0242; A63B 2208/0247; A63B 2208/0252
USPC ..... 482/23, 72, 73, 92, 93, 130, 133, 140, 482/142–145, 907
See application file for complete search history.

(56) References Cited

U.S. PATENT DOCUMENTS 1,705,745 A * 3/1929 Anderson ..... 482/123
3,006,643 A * 10/1961 Ryan ..... 482/142
4,004,801 A * 1/1977 Campanaro et al. ..... 482/96
4,508,335 A * 4/1985 Kelley et al. ..... 482/140
5,183,452 A * 2/1993 Bacon et al. ..... 482/97
5,441,473 A * 8/1995 Safani et al. ..... 482/130
5,607,381 A * 3/1997 Endelman ..... 482/142
6,206,809 B1 * 3/2001 Habing et al. ..... 482/96
7,074,165 B1 * 7/2006 Hodge et al. ..... 482/140
8,096,930 B1 * 1/2012 Leon ..... 482/142
8,172,736 B2 * 5/2012 Contreras ..... 482/142
D681,753 S * 5/2013 Ellison ..... D21/690
2003/0199372 A1 * 10/2003 Robinson et al. ..... 482/140
2011/0039668 A1 * 2/2011 McCall, Jr. ..... 482/142
2011/0319237 A1 * 12/2011 Jones et al. ..... 482/140
2012/0083394 A1 * 4/2012 Gregor et al. ..... 482/121

* cited by examiner

*Primary Examiner* — Stephen Crow
*Assistant Examiner* — Gregory Winter
(74) *Attorney, Agent, or Firm* — Plager Schack LLP

(57) ABSTRACT

An exercise apparatus allows a user lacking core muscle strength to perform a sit-up stand-up maneuver. The exercise apparatus includes a frame having a foot lowered portion, a head lowered portion, and a raised central portion having a knee bar. A back support is connected to the head lowered portion. A foot support and a foot plate are connected to the lower foot support to allow the user to engage one's feet to create leverage to elevate both upper and lower vertebrae from the back support and further facilitate the user to stand up to activate one's lower back muscles that are otherwise ignored in a conventional sit-up.

5 Claims, 4 Drawing Sheets

CORE EXERCISE APPARATUS

BACKGROUND

The embodiments herein relate generally to machines that can assist a user in performing physical exercise.

A sit-up is an abdominal strength training exercise commonly performed with the aim of strengthening the hip flexors and abdominal muscles. It has overlap with crunch.

The sit-up begins with lying with the back on the floor, typically with the arms across the chest or hands behind the head and the knees bent in an attempt to reduce stress on one's back muscles and spine, and then elevating both the upper and lower vertebrae from the floor until everything superior to the buttocks is not touching the ground.

Prior to the disclosed invention, performing the sit-up worked a limited amount of one's core muscles—the hip flexors and the abdominal muscles as indicated above. The present invention solves this problem by allowing a user to complete a "stand-up sit up" which provides additional core muscle exercise.

SUMMARY

An exercise apparatus allows a user lacking core muscle strength to perform a sit-up stand-up maneuver. The exercise apparatus includes a frame having a foot lowered portion, a head lowered portion, and a raised central portion having a knee bar. A back support is connected to the head lowered portion. A foot support and a foot plate are connected to the lower foot support to allow the user to engage one's feet to create leverage to elevate both upper and lower vertebrae from the back support and further facilitate the user to stand up to activate one's lower back muscles that are otherwise ignored in a conventional sit-up.

BRIEF DESCRIPTION OF THE FIGURES

The detailed description of some embodiments of the invention will be is made below with reference to the accompanying figures, wherein like numerals represent corresponding parts of the figures.

DETAILED DESCRIPTION OF CERTAIN EMBODIMENTS

Figure 1:
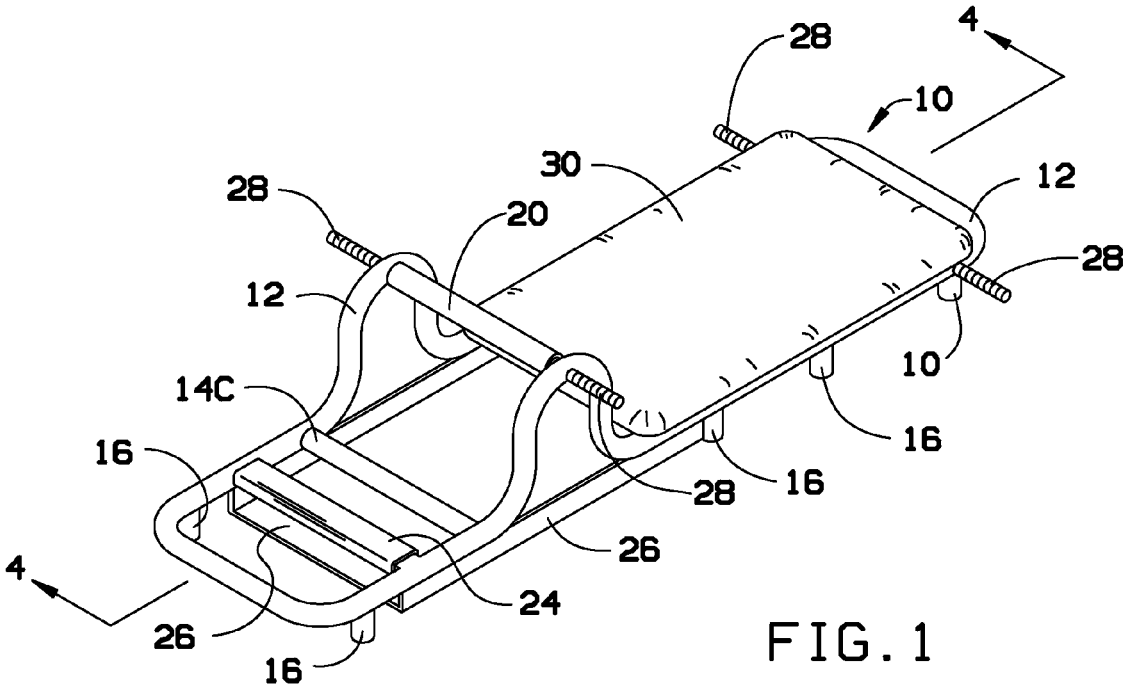
FIG. 1 is a top perspective view of an embodiment of the invention.
Figure 2:
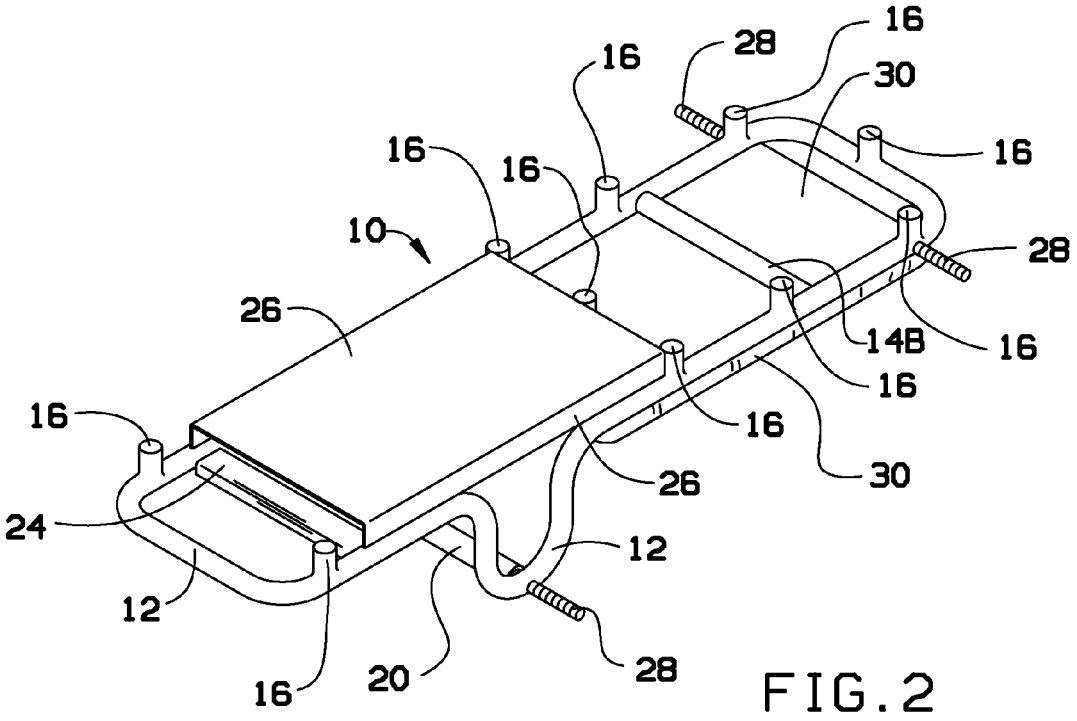
FIG. 2 is a bottom perspective view of an embodiment of the invention.

By way of example, and referring to FIG. 1, one embodiment of the present system comprises Exercise apparatus 10 further comprising outer frame 12. Outer frame 12 has he general shape of a rectangular ellipsoid with a raised central portion, a foot lowered portion and a head lowered portion.

Figure 4:
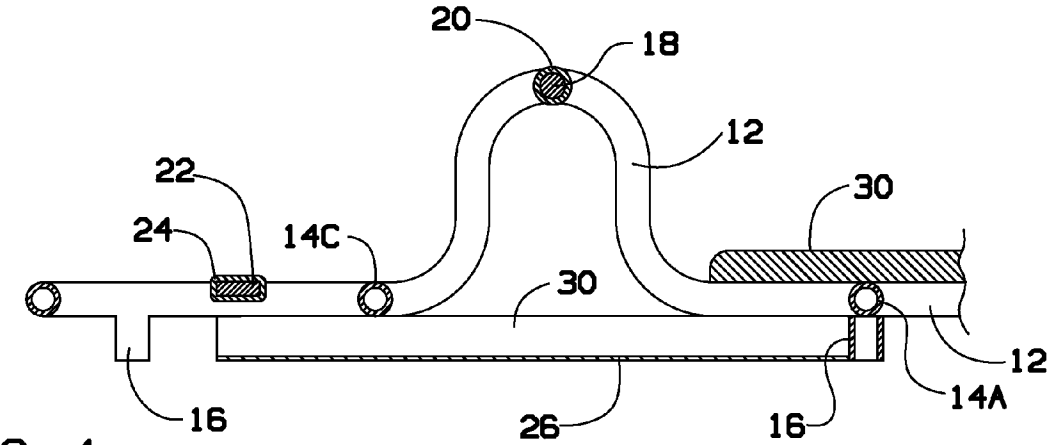
FIG. 4 is a section view of an embodiment of the invention, taken along line 4-4 in FIG. 1.

The foot lowered portion is mechanically coupled to foot plate 26 which is further mechanically coupled to the head lowered portion with a first leg 16 and a second leg 16. The foot lowered portion is further mechanically coupled to foot support 22 which is immediately adjacent to foot support foam pad 24 as shown in FIG. 4. The foot lowered portion is further mechanically coupled to foot cross member 14 which provides additional support for exercise apparatus 10. The foot lowered portion is mechanically coupled to third leg 16 and fourth leg 16.

Figure 3:
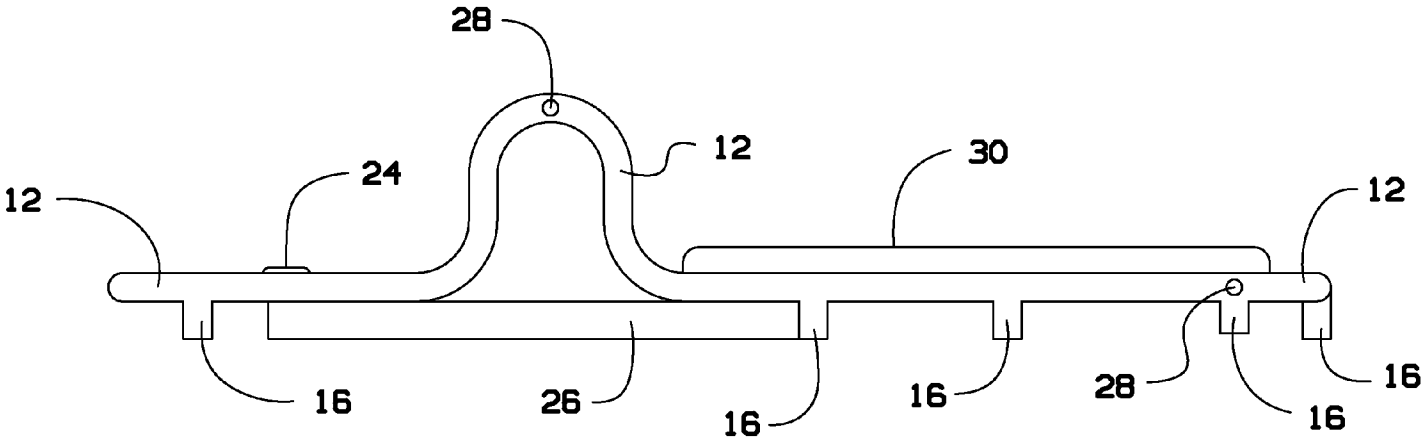
FIG. 3 is a side view of an embodiment of the invention.

Turning to FIG. 3 and FIG. 4, the raised central portion is mechanically coupled to knee bar 18 which is immediately adjacent to knee bar pad 20, which increases user comfort. Proximate knee bar 18, the raised central portion is mechanically coupled to raised left handle 28 and raised right handle 28.

Figure 5:
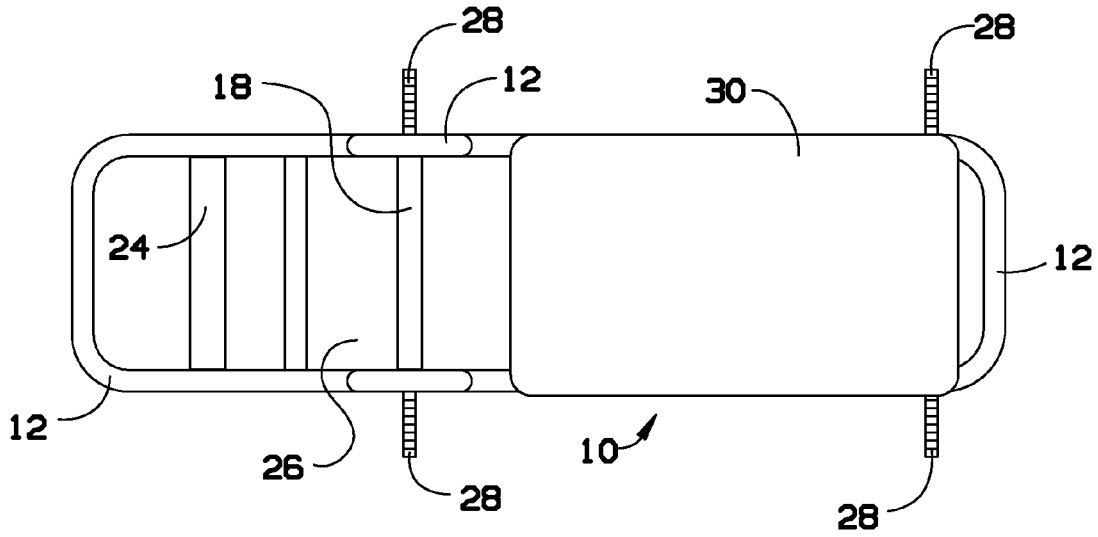
FIG. 5 is a top view of an embodiment of the invention.
Figure 6:
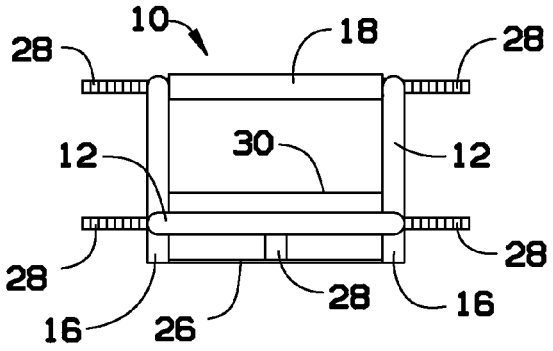
FIG. 6 is a front view of an embodiment of the invention.

The lower head portion is mechanically coupled to fifth leg 16, sixth leg 16, seventh leg 16, eight leg 16, and ninth leg 16 the position of legs 16 provides structural strength and stability. Shorter legs 16 are better able to hold a greater amount of weight of a user. The lower head portion is further mechanically coupled to first head cross member 14A. First head cross member 14A is mechanically coupled to tenth leg 16. The lower head portion is further mechanically coupled to second head cross member 14B which provides exercise apparatus 10 with additional support. As shown in FIG. 5 and FIG. 6, the lower head portion is further mechanically coupled to lower left handle 28 and lower right handle 28. The lower head portion is covered by back support 30.

To use exercise apparatus 10 a user lays with back on back support 30 with knees over knee bar 18 and feet with heels on foot cross member 14C while toes are beneath foot support 22 and thus proximate foot plate 26. The user then elevates both the upper and lower vertebrae from back support 30 until everything superior to the buttocks is not touching the ground as in a traditional sit-up. However, the user continues the exercise by proceeding to stand up, this continues to exercise the user's lower back muscles that are otherwise ignored in the conventional sit-up, the user once standing then sits down onto back support 30 and reclines until the user is lying on back support 30. This completed exercise is a "sit-up stand-up."

Figure 7:
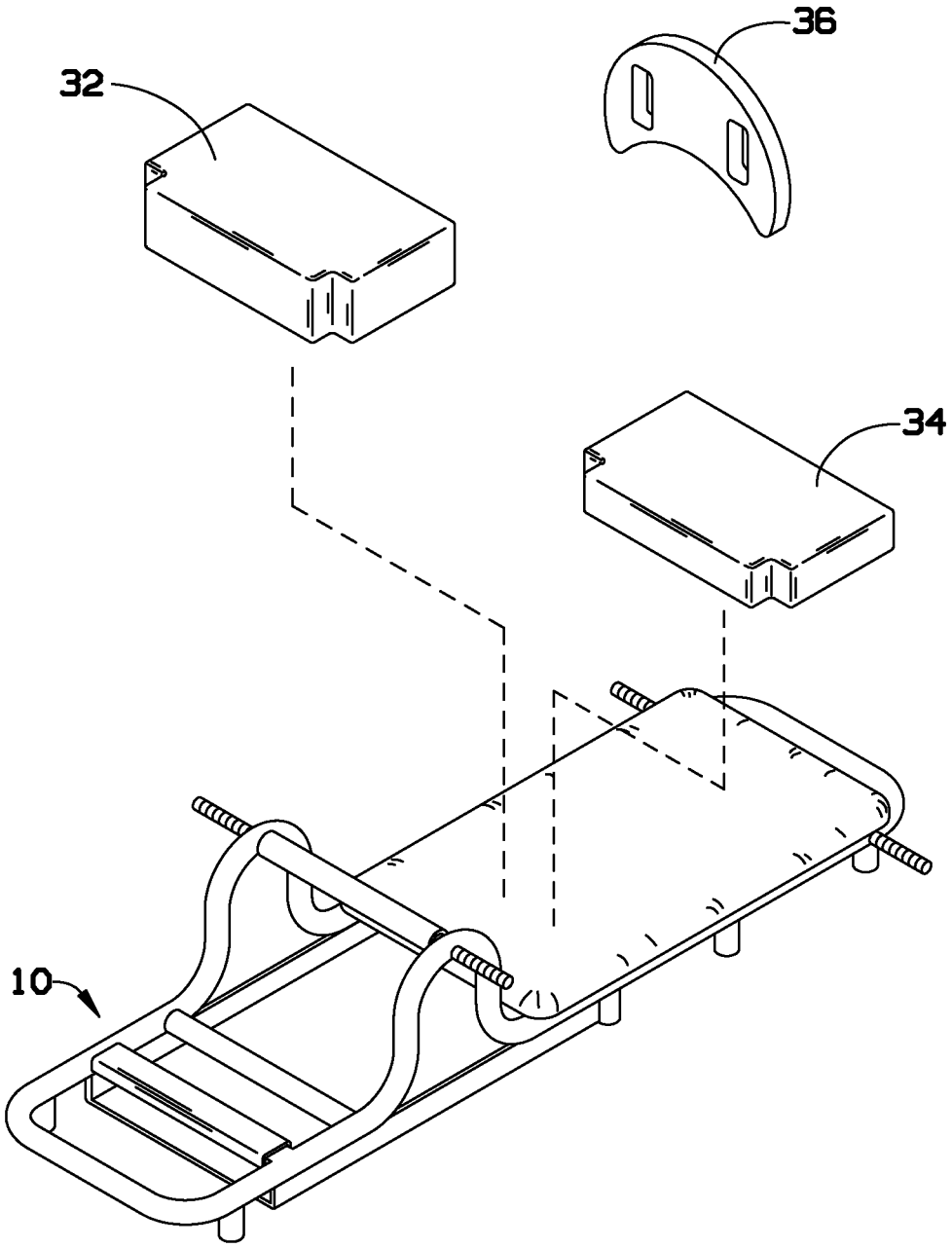
FIG. 7 is a perspective view of an embodiment of the invention, shown with accessories.

The sit-up stand-up is an extremely difficult exercise to perform without assistance particularly for users lacking core muscle strength because most users lack the muscle coordination to perform the exercise. The present invention provides several features to assist a user in completing the exercise. First, the location of knee bar 18, foot cross member 14C and foot support 22 hold the user's knees and feet in place reducing the amount of muscle coordination needed to perform the sit-up stand-up. Second, the user can, after completing the sit-up grab onto raised left handle 28 and raised right handle 28 to increase coordination while developing muscle memory to perform the sit-up stand-up. Third, FIG. 7 shows additional accessories that can be used with exercise apparatus 10. If a user lacks the lower back strength to perform the sit-up stand-up the user can place wither large back cushion 32 or small back cushion 34 beneath the user's back to raise the user's back further from back support 30 and thus provide more leverage for the user to complete the sit-up stand-up. Fourth, if a user has perfected this exercise and requires greater challenge the user can accomplish this by carrying hand-held weight 36 while performing the sit-up stand-up.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An exercise apparatus that allows a user lacking core muscle strength to perform a sit-up stand-up maneuver, the exercise apparatus comprising:

a frame comprising a foot portion, a head portion, and a central portion fixedly attached to the foot portion and the head portion and having a knee bar; wherein the central portion is elevated above the foot portion and the head portion when the exercise apparatus is stably placed on a ground surface;

a back support mechanically coupled to the head portion;

a foot plate traversing beneath the central portion directly and fixedly attached to the head portion with a first leg and a second leg and mechanically coupled to the foot portion; wherein the first leg and the second leg are orthogonal against the ground surface and the foot plate contacts the ground surface when the exercise apparatus is stably placed on the ground surface;

a first head cross member attached to the head portion parallel to the back support;

a second head cross member attached to the head portion parallel to the back support; wherein the first head member and the second head member provide the exercise apparatus with additional support and are below the back support when the exercise apparatus is stably placed on the ground surface; and a foot cross member attached to the foot portion above the foot plate and parallel to the foot plate when the exercise apparatus is stably placed on the ground surface;

wherein the exercise apparatus is configured to allow the user to engage one's feet to create leverage to elevate both upper and lower vertebrae from the back support and further facilitate the user to stand up to activate one's lower back muscles that are otherwise ignored in a conventional sit-up.

2. The exercise apparatus of claim 1, wherein the knee bar is immediately adjacent to a knee bar pad and the foot support is immediately adjacent to a foot support foam pad in order to increase user comfort.

3. The exercise apparatus of claim 1, wherein the foot portion is mechanically coupled to a third leg and fourth leg; the head portion is mechanically coupled to a fifth leg, a sixth leg, a seventh leg, an eighth leg, and a ninth leg each orthogonal to the ground surface when the exercise apparatus is stably placed on the ground surface.

4. The exercise apparatus of claim 1, wherein the back support is immediately adjacent to a small back cushion to raise a user's back from the back support.

5. The exercise apparatus of claim 1, wherein the back support is immediately adjacent to a large back cushion to raise a user's back from the back support.

* * * * *